US006914203B2

(12) United States Patent
Suzuki

(10) Patent No.: US 6,914,203 B2
(45) Date of Patent: Jul. 5, 2005

(54) OPERATION BUTTON STRUCTURE

(75) Inventor: Shinji Suzuki, Asaka (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 377 days.

(21) Appl. No.: 10/207,812

(22) Filed: Jul. 31, 2002

(65) Prior Publication Data

US 2003/0024795 A1 Feb. 6, 2003

(30) Foreign Application Priority Data

Aug. 2, 2001 (JP) ..... 2001-234855

(51) Int. Cl.[7] ..... H01H 19/00
(52) U.S. Cl. ..... 200/6 A; 200/5 A
(58) Field of Search ..... 200/5 A, 6 A, 200/5 D, 5 E, 1 R, 18, 4, 329, 341, 6 C, 516, 517

(56) References Cited

U.S. PATENT DOCUMENTS 4,408,103 A * 10/1983 Smith, III ..... 200/6 A
5,430,262 A * 7/1995 Matsui et al. ..... 200/5 A
5,655,650 A * 8/1997 Naitou ..... 200/553
5,929,401 A * 7/1999 Flegeo et al. ..... 200/5 A
6,080,940 A * 6/2000 Rice ..... 200/5 A
6,153,843 A * 11/2000 Date et al. ..... 200/339
6,271,487 B1 * 8/2001 Domzalski et al. ..... 200/1 B
6,348,664 B2 * 2/2002 Kozuma ..... 200/6 A
6,399,904 B1 * 6/2002 Mimata ..... 200/6 A
6,423,911 B2 * 7/2002 Yoshida et al. ..... 200/6 A
6,441,753 B1 * 8/2002 Montgomery ..... 341/34
6,515,242 B2 * 2/2003 Takatsuki ..... 200/6 A
6,541,716 B2 * 4/2003 Gotoh ..... 200/6 A
6,580,039 B2 * 6/2003 Nakade et al. ..... 200/6 A

* cited by examiner

*Primary Examiner*—Michael Friedhofer
*Assistant Examiner*—Lisa Klaus
(74) *Attorney, Agent, or Firm*—Sughrue Mion, PLLC

(57) ABSTRACT

In the operation button structure, pressing switch contact portions are satisfactorily pressed by a tilting button operating member even if the button operating member and the switch contact portions are a long distance apart from each other or positions of the switch contact portions vary. When an operator's finger presses a right end of a button operating member, a pressing portion on a right side moves in a direction perpendicular to an upper surface of a substrate, whereby a switch contact portion on the right side is pressed. On the other hand, when the finger is lifted from the button operating member, the pressing portion retracts from the switch contact portion by a connecting portion formed in a shape having elasticity.

4 Claims, 3 Drawing Sheets

OPERATION BUTTON STRUCTURE

BACKGROUND OF THE INVENTION

1. Field of the Invention

The present invention relates to an operation button structure and, in particular, to an operation button structure for tilting a button operating member to turn on/off a switch contact portion.

2. Description of the Related Art

In a multi-functional cursor button (cross button) or a zoom button or the like provided in a digital camera, when a button operating member is not pushed in straight but operated to tilt ("tilt" includes "turn"), a switch contact portion on a switch substrate that is disposed to oppose the button operating member is directly pressed by the button operating member and brought into a conduction state (switched on).

Usually, the switch substrate in which switch contact portions are implemented is provided independently from other substrates (a power source substrate, a system substrate or the like). However, the switch substrate may be required to be integrated with the other substrates in order to realize miniaturization and cost reduction of a camera main body. The substrate integrated with the other substrates in this way may be installed in a housing or a chassis that is separate from a housing in which the button operating member is disposed.

Due to the conditions as described above, the button operating member and the switch contact portions may be a long distance apart from each other or positions of the switch contact portions may vary. In such a case, a position to be pressed by the button operating member deviates from the center of the switch contact portion or the direction of pressing the switch contact portion excessively leans with the result that touch in pressing is deteriorated or, in a worst case, the switch contact portions cannot be pressed.

SUMMARY OF THE INVENTION

The present invention has been achieved in view of the above and other drawbacks, and it is an object of the present invention to provide an operation button structure with which pressing switch contact portions are satisfactorily pressed by a tilting button operating member even if the button operating member and the switch contact portions are a long distance apart from each other or the positions of the switch contact portions vary.

In order to attain the foregoing object, the present invention is directed to an operation button structure, comprising: a button operating member which is tiltably disposed in a housing; a switch contact portion which is provided on a substrate disposed to oppose the button operating member; and an intermediate member which is disposed between the button operating member and the switch contact portion movably in a direction perpendicular to a surface of the substrate, and moves and presses the switch contact portion on the substrate in association with a pressing operation of the button operating member.

According to the present invention, the intermediate member is disposed between the button operating member and the switch contact portion such that, when the button operating member is pressed, the intermediate member moves in the direction perpendicular to the upper surface of the substrate to press the switch contact portion. Consequently, the button operating member can accurately press the switch contact portion and defective contact can be prevented.

The present invention is also directed to an operation button structure, comprising: a button operating member which is tiltably disposed in a housing; a plurality of switch contact portions which are provided on a substrate disposed to oppose the button operating member; and an intermediate member which is disposed between the button operating member and the switch contact portions movably in a direction perpendicular to a surface of the substrate, and moves and presses at least one of the switch contact portion on the substrate in association with a pressing operation of the button operating member, wherein: the intermediate member comprises: a plurality of pressing portions which respectively oppose the plurality of switch contact portions, each of the plurality of pressing portions including a guide shaft guided in the direction perpendicular to the surface of the substrate; an attaching portion which attaches the intermediate member to the housing; and a connecting portion which connects the plurality of pressing portions and the attaching portions, the plurality of pressing portions, the attaching portion and the connecting portion are integrally molded with resin, and the connecting portion acts as an elastic member which returns each pressing portion to a position where the pressing portion retracts from the switch contact portion when the pressing portion is not pressed by the button operating member.

According to the present invention, the connecting portion of the intermediate member acts as an elastic member, whereby the button operating member can press the switch contact portions with high accuracy.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

A preferred embodiment of an operation button structure in accordance with the present invention will be described in detail with reference to the attached drawings. Further, in the following description, a case in which the operation button structure in accordance with the present invention is applied to a digital camera will be described.

Figure 1:
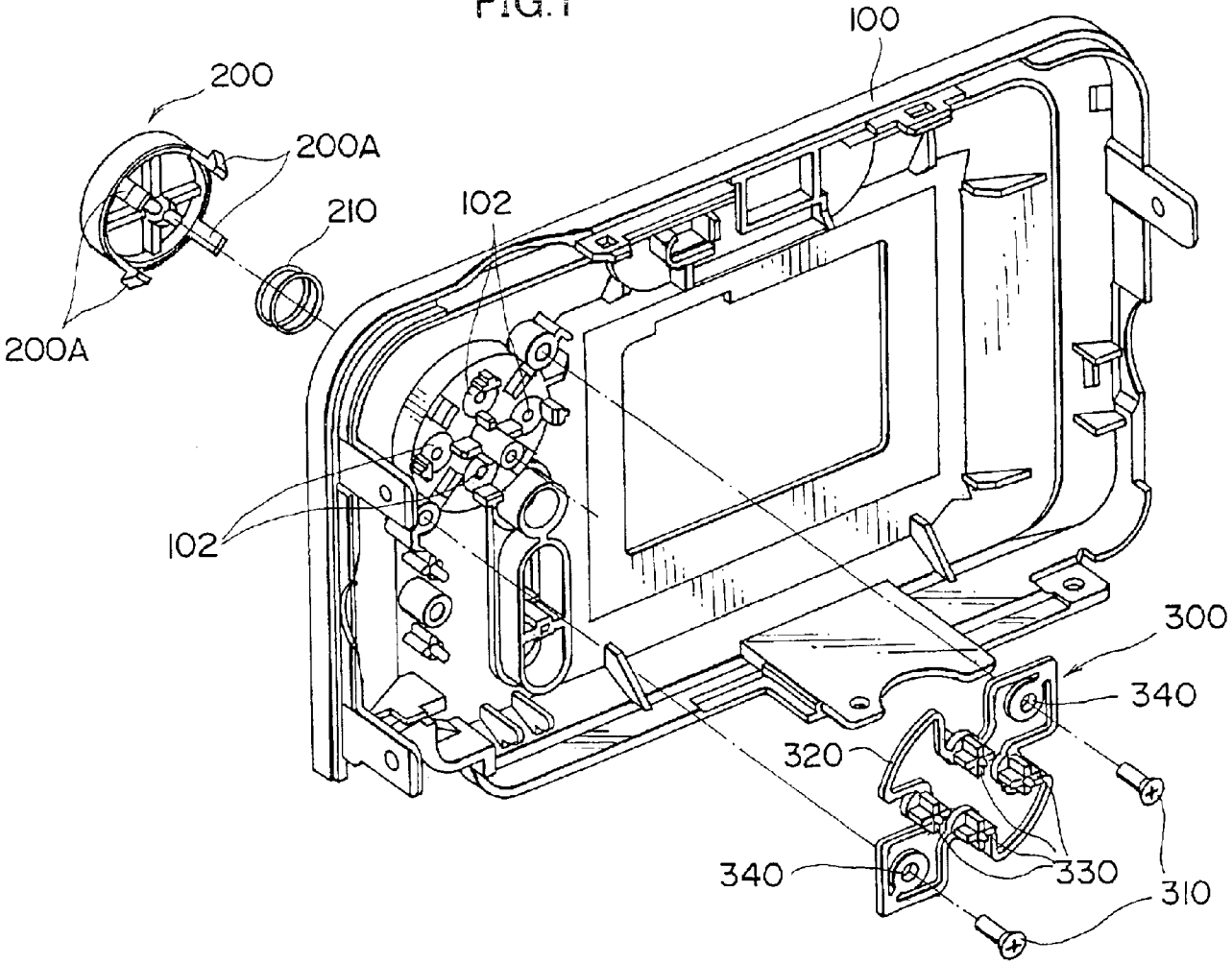
FIG. 1 is an exploded perspective view showing an operation button structure in accordance with the present invention.
Figure 2:
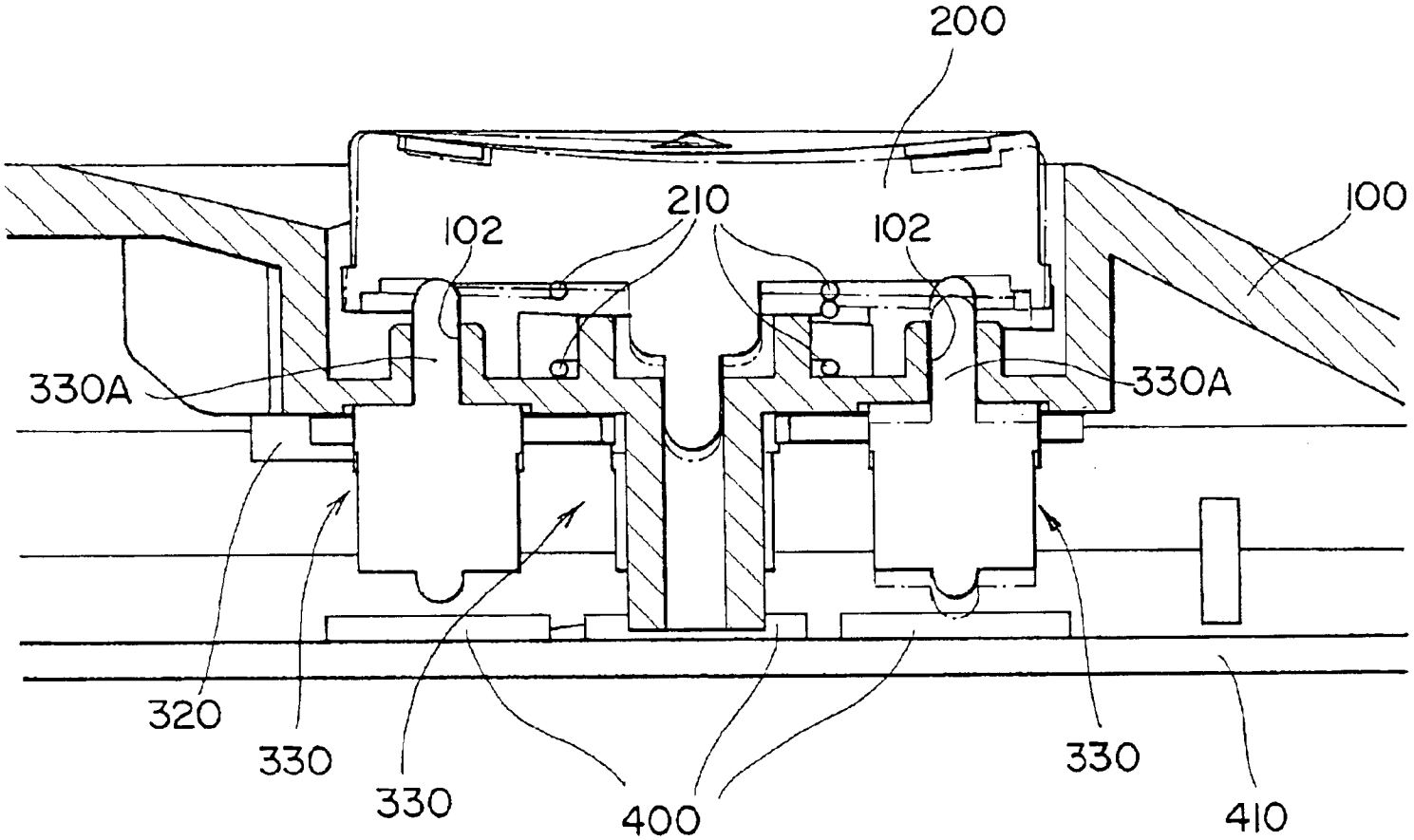
FIG. 2 is a sectional view showing the operation button structure in accordance with the present invention.

FIG. 1 is an exploded perspective view showing the operation button structure in accordance with the present invention and FIG. 2 is a sectional view of the same.

As shown in these drawings, this operation button is a cross button and comprises a button operating member (key top) 200, a coil spring 210 and an intermediate member 300, which are disposed in a housing (rear cabinet) 100 of the digital camera, respectively, and switch contact portions 400 on a substrate 410 disposed in a front cabinet or a chassis in the camera.

The button operating member 200 is mounted from an outside of the rear cabinet 100 sandwiching the coil spring 210 between them and is adapted to be tiltable in a direction in which its upper, lower, right or left position is pressed. That is, the button operating member 200 has four pawl portions 200A integrally formed therein and is mounted by pressing the pawl portions 200A in holes formed in the rear cabinet 100. After the button operating member 200 is mounted in the rear cabinet 100, the button operating member 200 is energized upward by the coil spring 210 but is prevented from being disengaged by the pawl portions 200A.

Figure 3:
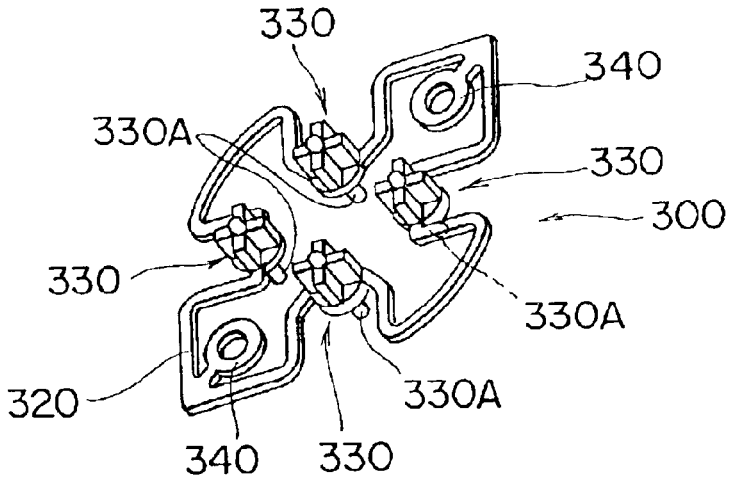
FIGS. 3(*a*) to 3(*c*) are detailed views showing an intermediate member.
Figure 3:
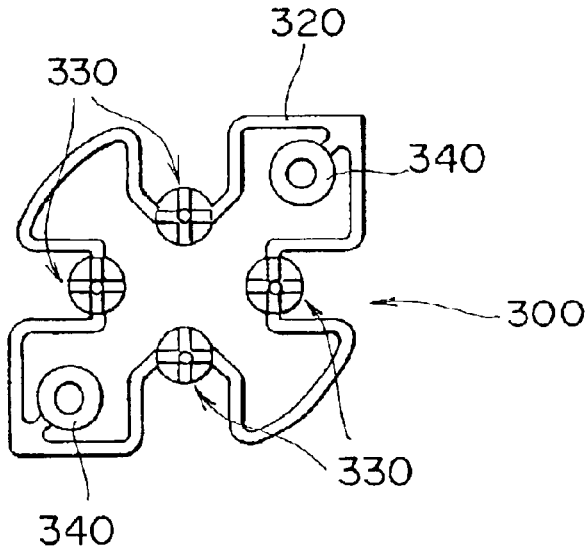
Figure 3:
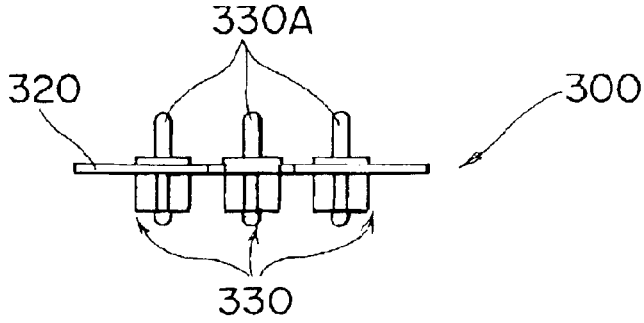

FIGS. 3(*a*), 3(*b*) and 3(*c*) show details of the intermediate member 300. FIG. 3(*a*) is a perspective view of the intermediate member 300, FIG. 3(*b*) is a top view of the intermediate member 300, and FIG. 3(*c*) is a side view of the intermediate member 300.

As shown in these drawings, the intermediate member 300 is a part integrally formed with resin and has four pressing portions 330, two attaching portions 340 and a connecting portion 320 for connecting the pressing portions 330 and the attaching portions 340. Each pressing portion 330 has a guide shaft 330A. The connecting portion 320 is formed in a shape having elasticity.

The intermediate member 300 in the above-described configuration is attached to an inner side of the rear cabinet 100 with the attaching portions 340 fastened to the rear cabinet 100 with screws 310 as shown in FIG. 1. In this case, the guide shaft 330A of each pressing portion 330 is inserted through a guide hole 102 formed in the rear cabinet 100 as shown in FIG. 2, whereby each pressing portion 330 is guided movably in a vertical direction on FIG. 2 (i.e., a direction perpendicular to the upper surface of the substrate 410) and is supported with elasticity by the connecting portion 320.

Each pressing portion 330 corresponds to a pressing point in an operating direction (up, down, right or left) of the button operating member 200 and moves independently from the other pressing portions in the direction perpendicular to the upper surface of the substrate 410 in association with a pressing operation of the button operating member 200 to press the switch contact portions 400 on the substrate 410.

The four switch contact portions 400 (only three are shown on FIG. 2) are provided on the substrate 410 disposed to oppose the button operating member 200 and are turned on/off via the pressing portions 330 of the intermediate member 300.

Next, operations in the operation button structure in accordance with the present invention will be described.

On FIG. 2, when the operator's finger presses the right end of the button operating member 200, the button operating member 200 tilts in the clockwise direction and the pressing portion 330 on the right side of the intermediate member 300 moves downward in association with the tilting of the button operating member 200. Consequently, the switch contact portion 400 on the right side is pressed by the pressing portion 330 on the right side to be turned on.

On the other hand, when the finger is lifted from the button operating member 200 (i.e., pressing is released), the button operating member 200 returns to the original horizontal state by an energizing force of the coil spring 210. Then, the pressing portion 330, which has pressed the switch contact portion 400, moves upward by elasticity of the connecting portion 320 and retracts from the switch contact portion 400 to turn it off.

As described above, the pressing portions 330 are moved in the direction perpendicular to the upper surface of the substrate 410, whereby the button operating member 200 can press the switch contact portions 400 vertically even if the button operating member 200 is long distance apart from the substrate 410.

Further, although the coil spring 210 for returning the button operating member 200 to the horizontal position is provided in this embodiment, the button operating member 200 may be returned to the horizontal position by an energizing force for returning the intermediate member 300 to the original position without providing the coil spring 210.

Although one intermediate member 300 is provided for the plurality of switch contact portions 400 in this embodiment, the present invention is not limited to this. Separate intermediate members may be provided for switch contact portions, respectively. Separate elastic members for returning the intermediate members to their original positions may be provided.

Further, although the case in which the present invention is applied to a cross button is described in this embodiment, the present invention can be applied to various shapes of buttons such as a seesaw type button and a button tilting in a plurality of directions other than the cross button regardless of their uses.

Moreover, the operation button structure of the present invention can be widely applied to various kinds of electronic appliances such as a video camera, a silver-halide film camera, a mobile phone and a personal digital assistant other than a digital camera regardless of their uses.

As described above, according to the operation button structure in accordance with the present invention, since the intermediate member is provided between the tilting button operating member and the switch contact portions, the button operating member can surely press the switch contact portions and defective contact can be prevented even if the button operating member and the switch contact portions are a long distance apart from each other.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An operating button structure, comprising:

a button operating member which is tiltably disposed in a housing;

a plurality of switch contact portions which are provided on a substrate disposed to oppose the button operating member; and an intermediate member which is disposed between the button operating member and the switch contact portions movably in a direction perpendicular to a surface of the substrate, and moves and presses at least one of the switch contact portions on the substrate in association with a pressing operation of the button operating member, wherein:

the intermediate member comprises:

a plurality of pressing portions which respectively oppose the plurality of switch contact portions, each of the plurality of pressing portions including a guide shaft guided in the direction perpendicular to the surface of the substrate;

an attaching portion which attaches the intermediate member to the housing; and a connecting portion which connects the plurality of pressing portions and the attaching portions;

the plurality of pressing portions, the attaching portion, and the connecting portion being integrally molded with resin; and the connecting portion acts as an elastic member which returns each pressing portion to a position where the pressing portion retracts from the switch contact portion when the pressing portion is not pressed by the button operating member.

2. The operation button structure of claim 1, wherein the button operating member is tiltable in a plurality of operating directions; and each of the plurality of pressing portions:

corresponds to an operating direction, and moves independently from the others of the plurality of pressing portions.

3. The operation button structure of claim 2, wherein the intermediate member includes four pressing portions and the button operating member is tiltable toward at least one of an up operating direction, a down operating direction, a left operating direction, and a right operating direction; and each pressing portion corresponds to one of the up, down, left, and right operating directions.

4. The operation button structure of claim 1, wherein the connecting portion is operative to resist a pressing operation of the button operating member.

* * * * *